United States Patent [19]

Zyduck

[11] 4,445,823

[45] May 1, 1984

[54] ANIMAL WASTE PUMPING SYSTEM

[75] Inventor: Ronald L. Zyduck, Mosinee, Wis.

[73] Assignee: Acorn Equipment Corp., Stevens Point, Wis.

[21] Appl. No.: 322,490

[22] Filed: Nov. 18, 1981

[51] Int. Cl.[3] ..... F04B 21/00

[52] U.S. Cl. ..... 417/430; 417/551; 92/128; 92/171

[58] Field of Search ..... 417/551, 430; 366/332, 366/333, 267; 92/128, 169, 171, 177

[56] References Cited

U.S. PATENT DOCUMENTS

| | | | |
|---|---|---|---|
| 643,985 | 2/1900 | Salisbury | 417/551 |
| 665,506 | 1/1901 | Carlson | 92/183 |
| 1,051,092 | 1/1913 | Durham | 417/430 |
| 1,527,353 | 2/1925 | Findley | 417/430 |
| 2,201,739 | 5/1940 | Nicholson | 92/169 |
| 2,231,941 | 2/1941 | Ohman | 417/551 |
| 2,392,182 | 1/1946 | Payne | 92/183 |
| 3,233,554 | 2/1966 | Huber et al. | 417/534 |
| 3,687,311 | 8/1972 | Nesseth | 214/16 R |
| 3,800,751 | 4/1974 | Glassey et al. | 92/171 |
| 3,872,981 | 3/1975 | Hedlund | 214/16 R |
| 3,981,635 | 9/1976 | Hedlund | 417/551 |
| 4,293,282 | 10/1981 | Nesseth et al. | 417/551 |

OTHER PUBLICATIONS

"Patz, Manure Movers, Mechanical and Compressed Air Types", published by Patz, Jul. 1979.

"Powerful, Hydraulically Operated Pump Provides Almost Unlimited Volume!", illustrating pump sold by Hedlund Mfg. Co., Inc.

"Nesseth Hollow Piston", page illustrating pump sold by Nesseth Inc.

"Badger Transfer Pumps", published by Badger Northland Inc.

*Primary Examiner*—Carlton R. Croyle
*Assistant Examiner*—Paul F. Neils
*Attorney, Agent, or Firm*—Quarles & Brady

[57] ABSTRACT

A hollow piston pump (10) for pumping animal waste material including paddles (55, 155, 255) to agitate waste material collected in a hopper (11) and aid in its transfer into the hollow piston (17), a pumping chamber (14) including a cylindrical tube (76), and/or a cylindrical hollow piston (17) having antifriction bearings (90) and a seal (91) between its outer surface and the cylindrical tube (76) of the pumping chamber (14).

8 Claims, 10 Drawing Figures

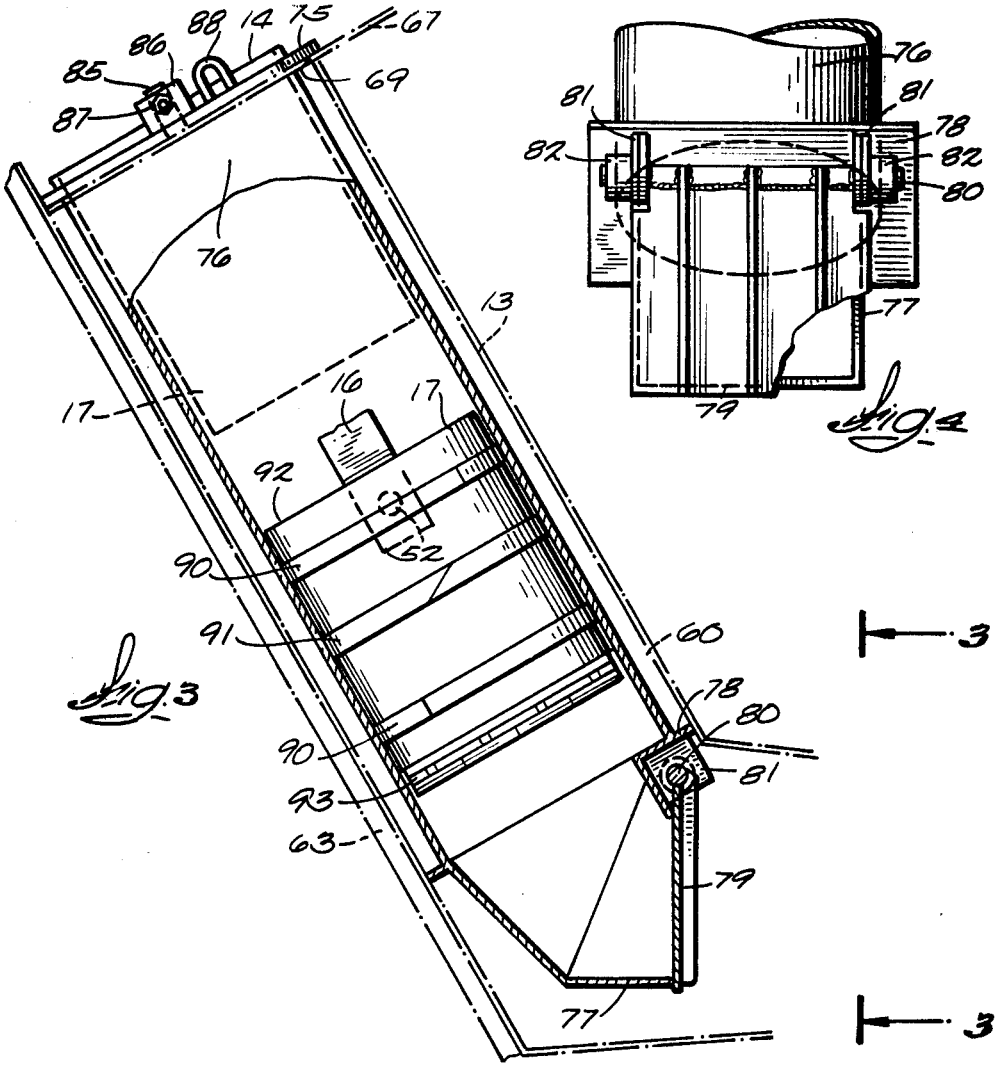
Fig. 3
Fig. 4
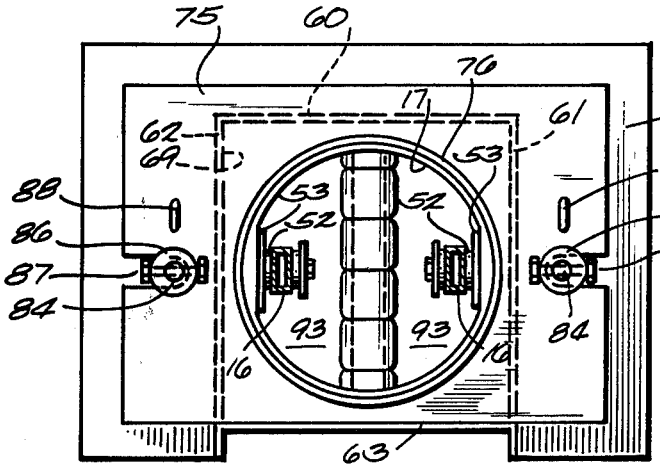
Fig. 2

ANIMAL WASTE PUMPING SYSTEM

TECHNICAL FIELD

This invention relates to the field of animal waste pumping systems adapted to transfer liquid and solid waste materials from a hopper to a collection point.

BACKGROUND ART

Animal waste material, both liquid and solid such as manure, urine, and straw bedding material, accumulate in an animal enclosure from which they must be periodically removed. Manure pumps have become increasingly popular in the last decade or so for transferring the animal waste material from a barn to a collection area located outside the barn. The manure is stored in the collection area and taken to the fields when ready.

A typical installation of a manure pump involves installing the pumping apparatus beneath the floor of a barn and running a discharge pipe from the apparatus to the collection area, which is generally a pit dug in the ground or other suitable manure holding area. The discharge pipe is as long as necessary to transport the manure the required distance. The pump apparatus includes a hopper opening onto the floor of the barn to receive animal waste material, generally from a suitable barn cleaning apparatus; when the pump apparatus is actuated, typically once or twice a day, the waste material collected in the hopper is pumped through the discharge pipe to the collection area where it is stored for future use.

One form of animal waste pumping apparatus, as successfully sold by the assignee of the present invention for example, employs a hopper with an open bottom through which the animal waste material collects in front of a reciprocating ram or piston that is actuated to pump the waste material through the discharge pipe. The waste material does not enter into the ram or piston of this type of apparatus, which is often referred to as a "solid piston" pump. This type of pump is particularly effective with animal wastes containing a large amount of solid materials.

Another form of animal waste pumping apparatus utilizes a hollow piston through which the waste material flows during operation of the equipment. The hollow piston has an open top and/or open rear end through which the waste material collected in the hopper enters into the piston. A gate valve is associated with the piston and opens during the return stroke of the hollow piston to allow the waste material to flow through and in front of the piston; the gate valve closes during the pumping stroke of the piston so that the waste material can be pumped through the discharge piping associated with the apparatus. The hollow piston type of pump is generally considered to be advantageous for use with waste material containing a relatively large proportion of liquids. Several companies now manufacture hollow piston pumps of various constructions. U.S. patents relating to hollow piston pumps include U.S. Pat. Nos. 3,872,981, 3,687,311 and 3,981,635.

The present invention relates to a hollow piston type of animal waste pumping system and provides several features which I believe improve upon the hollow piston manure pumps presently available. The hollow piston pumps of which I am aware exhibit one or more of the following deficiencies: (1) waste materials containing large amounts of dry material such as long straw bedding can cause difficulties by plugging or blocking the entry of material into the hollow piston; (2) waste material collected in the hopper of the pump can become caked or somewhat solidified and thereby cause inefficient flow of waste material into the hollow piston; (3) while all of the pumps contain a hollow piston reciprocating with a pumping chamber, none of them provides for effective low friction movement of the piston within the chamber or effective sealing of the pump and chamber to prevent sprayback of waste material; (4) with some pumps, it is difficult to repair or replace parts associated with the hollow piston after the pump has been installed.

DISCLOSURE OF THE INVENTION

My present invention provides an animal waste material pump including one or more of the following features: paddles associated with driving arms for reciprocating a hollow piston that are arranged to agitate waste material collected in the hopper of the pump and to facilitate flow of the waste material into the hollow piston of the pump, a cylindrical hollow piston including bearing means and sealing means between it and a pumping chamber, and a pumping chamber including a cylindrical tube in which the hollow piston is journalled and preferably constructed to be readily removed from a housing for maintenance work when necessary. These features are most useful when all are combined in a single pump apparatus, but each of them may be employed singly with hollow piston types of animal waste material transfer pumps.

One of the objects of my invention was to design a hollow piston animal waste pump that incorporated a cylindrical hollow piston so as to provide for effective sealing between the piston and a chamber within which it reciprocates. Another was to provide a hollow piston manure pump apparatus that incorporates paddle means for agitating waste material collected in the hopper to thereby enable efficient handling of various types of waste material and facilitate flow of the waste material into the hollow piston for subsequent pumping. Still another was to develop a hollow piston manure pump apparatus incorporating a pumping chamber that can be removed readily whenever maintenance was required. Another important object was the provision of a manure pumping apparatus incorporating all of the foregoing features.

DRAWINGS

The manure pump of the present invention is described hereinafter in full and concise detail sufficient to enable those skilled in the art of designing and constructing manure pumps to practice the same by reference to the following drawings, in which:

FIG. 2 is a rear view of the pumping chamber and lower housing of the pump;

FIG. 3 is a side view, partly in section and with portions broken away, showing further details of the pumping chamber;

FIG. 4 is a front view of the pumping chamber shown in FIG. 3;

BEST MODES FOR CARRYING OUT THE INVENTION

(A) Mechanical Description

Figures 1, 10:
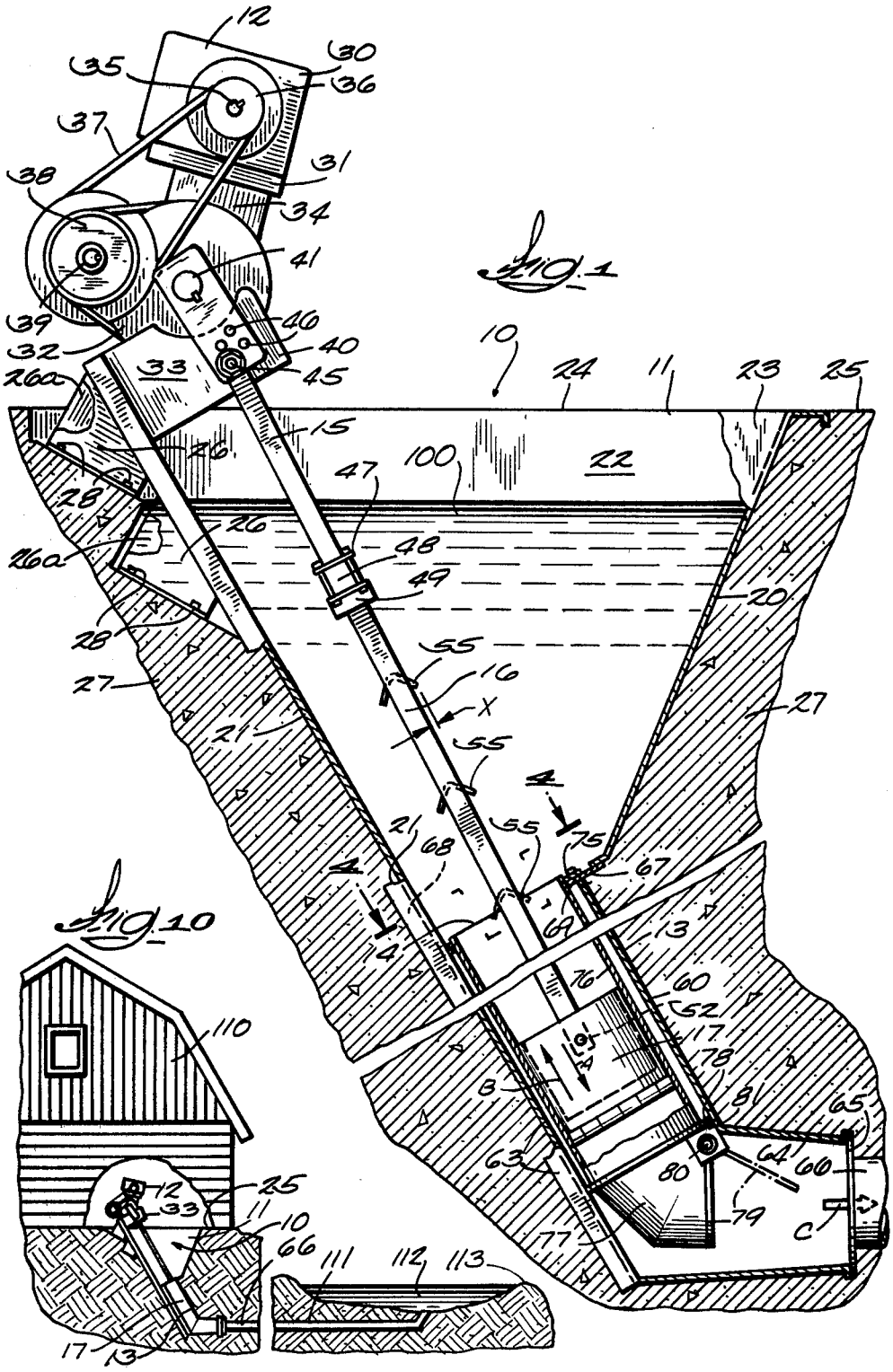
FIG. 1 is a side view, partly in section and with portions broken away, of a manure pump incorporating the novel features of this invention.
FIG. 10 depicts a typical installation of the manure pump.

FIGS. 1–7 illustrate a manure pump 10 incorporating novel features of my present invention. The principal elements of the pump 10 are a hopper 11, a power transmission 12 fixed in position along the top of the hopper, a lower housing 13, a pumping chamber 14 positioned inside the lower housing, and upper driving arms 15 and lower driving arms 16 connected between the power transmission and a cylindrical hollow piston 17. The power transmission and the upper and lower driving arms provide drive means reciprocating the hollow piston in the pumping chamber upon actuation of the power transmission.

The hopper 11 includes front wall 20, rear wall 21 and spaced side walls 22 and 23 arranged to define a generally triangular receptacle having a rectangular cross-section. The hopper has an open top 24 that opens onto the floor 25 of a barn or other enclosure. Suitable barn cleaning apparatus, not shown, of which several types are well known, may be installed in the barn to transport manure and other animal waste material along the floor of the barn into the hopper 11 through its open top. This collected manure and waste material will, as described in greater detail below, be pumped outside the barn to a collection pit or zone with the manure pump 10. A pair of spaced brackets 26 and a pair of spaced brackets 26A are secured to the rear wall 21 of the hopper and are used to secure the hopper in its desired position within concrete 27 by means of bolts 28. It will be noted that the pump 10 is embedded in the concrete 27 as is typical of installations of manure pumps of this type; this can lead to a problem with prior pumps of this type which is solved with one of the features of this invention.

The power transmission 12 includes an electric motor 30 mounted on a base 31 and arranged to drive a speed reducer 32. The speed reducer is carried on a pair of spaced lower supports 33 bolted to the rear wall 21 of the hopper, and the motor is carried on a pair of outer supports 34 attached to the speed reducer. The output shaft 35 of the motor 30 carries a pulley 36 which is drivingly connected through V-belt 37 to a pulley 38 carried on the input shaft 39 of the speed reducer. A pair of eccentric output links 40, only one of which is visible in FIG. 1, are keyed to the output shaft 41 of the speed reducer. The motor-speed reducer drive belt system illustrated as the power transmission 2 is exemplary only, as various types of power transmissions may be employed with the manure pump 10 of this invention such as, for example, gear drive units and chain drive units, as well as pneumatic or hydraulic drive means. The power transmission usually will be enclosed by a safety shield, not shown in the drawings.

Figure 6:
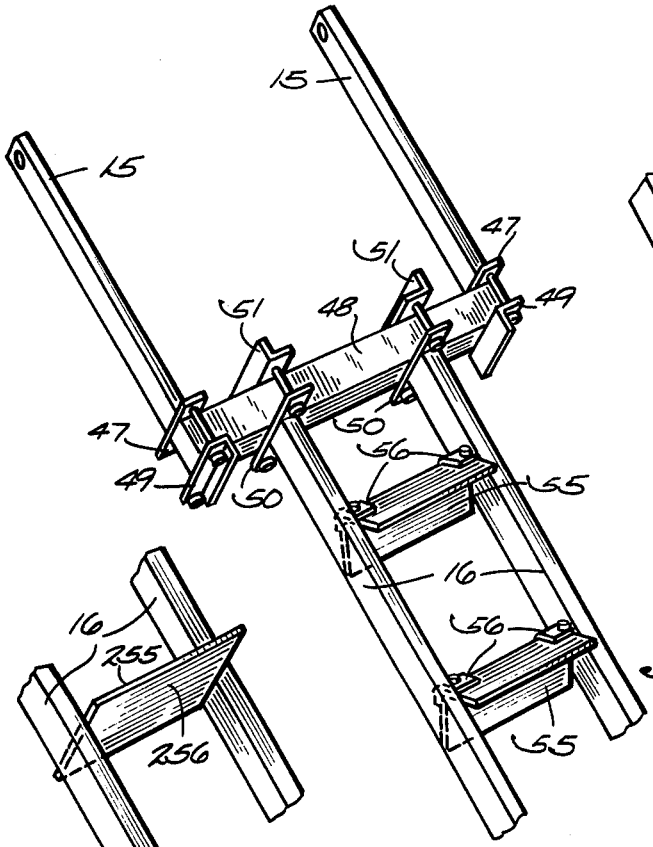
FIG. 6 is a perspective view illustrating the driving arms and paddles associated therewith of the pump.

A pair of spaced upper driving arms 15, see also FIG. 6, are secured at their upper ends to the output links 40 by means of bolts 45 that extend through apertures 46 in the output links. There are several apertures 46 as shown in FIG. 1 in the output links so that the length of stroke of the driving arms can be adjusted depending upon the pressure required for a particular pumping installation. The lower end of each driving arm 15, referring now to FIG. 6, carries a clamp plate 47 which is employed to secure the upper driving arms to a cross member 48 in conjunction with angles 49 positioned on the opposite side of the cross member and bolted to the clamp plates 47 in the manner illustrated in the drawings. The spaced lower driving arms 16 have clamp plates 50 at their upper ends which are used to secure the arm 16 to the cross bar 48 in the same manner by being bolted to angles 51. Considering next FIGS. 1 and 4, each lower driving arm 16 is journalled onto a stub shaft 52 that has one end seated in an aperture in the piston and extends through and is supported by a bracket 53 attached to the interior of the open back end of hollow piston 17, there being a stub shaft on each side of the piston as shown. In this fashion, the upper and lower driving arms form a driving assembly connecting the power transmission 12 to the hollow piston 17 to reciprocate the latter for pumping operation.

In accordance with this invention, a plurality of V-shaped paddles 55, there being three such paddles in the exemplary embodiment, are connected between the lower driving arms 16 and arranged to open towards the hollow piston 17. As best illustrated in FIG. 6, each paddle 55 is bolted near its ends to V-shaped brackets 56 welded to the inner surface of each arm 16. The purpose of the paddles 55 is explained hereinafter.

The lower housing 13 is formed of top wall 60, side walls 61 and 62, and bottom wall 63 (FIG. 2) arranged to define a square upright section of the housing. A square duct 64 (FIG. 1) forms a horizontal lower section of the housing 13 and has a front wall 65 through which a round conduit 66 extends to communicate with the interior of the housing 13 so as to receive waste material from the pumping chamber. The conduit 66 is for attachment to suitable discharge piping, not shown, through which manure and other waste material is to be pumped by the pump 10 to a collection pit or zone located outside of and generally several hundred feet away from the barn in which the pump is installed.

The lower housing 13 also includes a rear wall 67, to which the walls 60–63 are attached, as by welding. The rear wall 67 of the lower housing is bolted to the lower end of the hopper 11 about its perimeter, and may include flanges along its edges for this purpose. Also, the bottom wall 63 of the lower housing 13 is channel-shaped (see especially FIG. 2) and the rear wall 21 of the hopper 11 is also channel-shaped. The bottom wall 63 extends beyond the rear wall 67 of the lower housing to have a portion 68 (FIG. 1) that fits inside the channel-shaped rear wall 21 of the hopper and is bolted thereto, to provide a rigid backbone for the hopper and lower housing assembly. The rear wall 67 of the lower housing includes a rectangular aperture extending therethrough conforming to the inside perimeter of the section formed by the walls 60–63, as indicated by reference numeral 69 in FIGS. 1–3.

The pumping chamber 14 is drawn in full line in FIG. 3 to emphasize its structure, and the lower housing 13 is shown in dashed line. The pumping chamber is an integral unit formed of a mounting plate 75, a round cylindrical tube 76 attached at its one end to the mounting plate such as by welding, an elbow 77 attached to the opposite or lower end of the tube 76 to direct material flow horizontally, a rectangular spacer plate 78 secured to the tube 76 near its lower end to be positioned remote from the mounting plate, and a back flow gate 79 hinged along the spacer plate 78. The outside dimensions of the spacer plate 78 conform to the inside dimensions of the upright section of the lower housing 13 formed by the walls 60–63 and the spacer plate fits through the aperture 69 in the rear wall 67 of the lower housing. The mounting plate 75 of the pumping chamber is larger than the aperture 69. This construction of the pumping chamber elements allows the pumping chamber to be inserted into and withdrawn from the lower housing as a cartridge or unitary element for the purpose explained below.

As illustrated in FIG. 4, the back flow gate 79 has a horizontal shaft 80 along its top edge that is secured to brackets 81 on the spacer plate 78 by means of bolts 82. This attachment is made in such fashion as to allow the back flow gate to pivot to open and close the entrance to the elbow 77. The closed position of the back flow gate 79 is shown in full line in FIG. 1, and its open position is illustrated in dashed line.

The pumping chamber 14 is inserted into the lower housing 13 through the aperture 69 in the rear wall 67 of the lower housing. Locating pins 84 (see FIG. 2) are attached to and extend from the rear wall 67. The mounting plate 75 of the pumping chamber has slots 85 extending inwardly from its two side edges, and the pins 84 are received in the slots 85 when the pumping chamber is in its final position. Split collars 86 are secured to the pins 84 with bolts 87 to firmly hold the pumping chamber in position. This arrangement positions the tube 76 of the pumping chamber in spaced relationship to the interior of the lower housing, and this position is maintained at the lower end of the tube 76 by the spacer plate 78. U-shaped lifting lugs 88 are attached to the mounting plate 75 to facilitate insertion and withdrawal of the pumping chamber from the lower housing.

Returning again to FIG. 3, the cylindrical hollow piston 17 reciprocates inside the round tube 76 of the pumping chamber between its first position drawn in full line and its return position shown in dashed line. During its return stroke, the piston is moved from the first position to its return position; and during its pumping stroke the piston is moved from its return position to the first position. The piston 17 is journaled in the tube along split antifriction bearings 90, which are typically of brass or bronze or other suitable metal or plastic, retained in position in shallow annular grooves formed around the outer surface of the hollow piston. Further, the clearance space between the hollow piston and the tube 76 may be sealed by means of an annular seal 91, such as of neoprene, urethane or other appropriate material, also seated in an annular groove about the piston. The bearings 90 and seal 91 are split elements so that they can be replaced easily when necessary by withdrawing the piston 17 from the pumping chamber.

The end 92 of the hollow piston 17 is open in order to permit the entry into the piston of waste material to be pumped out of the hopper, and the lower driving arms 16 are connected to the piston through the open end 92. The opposite end of the hollow piston 17 is closed by a pair of hinged piston gates 93, best illustrated in FIG. 5. The piston gates 93 are hinged about a pin 94 fixed in place between upper and lower brackets 95 extending from the end of the hollow piston. The pin 94 is arranged vertically along the lower end of the hollow piston 17, and the piston gates are adapted to open during the return stroke of the piston 17 and close during the pumping stroke of the piston.

(B) Operational Description

Waste material, comprising both solids and liquids, such as manure, urine, water, and straw bedding material, is collected in the hopper 11 of the pump 10. The waste material may be conveyed into the hopper by barn cleaning apparatus having scrapers for cleaning the floor of a barn, or it can be transferred into the hopper manually by shovels, etc. After the waste material has reached a suitable level in the hopper, such as the level 100 in FIG. 1, the power transmission 12 is operated to reciprocate the cylindrical hollow piston 17 within the pumping chamber 14 through a pumping stroke indicated by the arrow A and a return stroke indicated by the arrow B. With the piston 17 in its first position as shown in FIG. 1, the waste material is to enter through the open end 92 of the piston and fill it. As the piston 17 is moved to its return position (dashed line in FIG. 3) during the return stroke, the piston gates 93 open to allow any such waste material to move down the inner tube 76 of the pumping chamber to in front of the piston. During the return stroke of the piston 17, the back flow gate 79 closes so that the waste material will not back up into the pumping chamber 14. Next, as the piston is reciprocated to its first position during the pumping stroke, the piston gates 93 close and push the material in front of the piston through the elbow 77 and through the back flow gate 79, which opens to its dashed line position of FIG. 1 to allow the waste material to be pumped through the conduit 66 in the direction of arrow C and into discharge piping connected thereto for transport to a storage location.

The paddles 55 perform a dual function. During the pumping stroke of the piston 17, which terminates in its first position shown in FIG. 1, the paddles operate to push waste material down into the open end 92 of the piston 17 and into the pumping chamber. As the piston moves through its pumping stroke, it tends to leave an empty area behind the pumping chamber, and the paddles 55 fill this area with waste material to be conveyed during the next pumping stroke of the pump. Secondly, waste material will often contain clumps of waste, such as straw bedding and other dry material, that tend to cake or harden so as to make it difficult to pump the waste material out of the hopper. Long bedding material, for example, can be difficult for a hollow piston pump to handle unless it has an unusually large piston. Also, dry waste material tends to bunch up and will often bridge or plug the open end of a hollow piston in a pump of the general type under consideration. The paddles 55 obviate these difficulties in connection with a hollow piston pump. During the return stroke, as well as during the pumping stroke, the paddles 55 operate to agitate the waste material contained in the hopper so as to mix it together and provide a more pumpable mass than is the case without the paddles. The waste material often contains liquids and the paddles function to mix the liquid and solid materials in the hopper to achieve a more fluid mass. Referring to the diagram of FIG. 7, it will be noted that the paddles 55 have a circular or elliptical motion when an eccentric-type power transmission, such as the transmission 12 is used, that is conducive to their mixing action. Also, it will be noted in FIG. 7 that the spacing and number of paddles is most usefully selected so that the path of travel of a paddle overlaps the path of travel of its adjacent paddles, i.e. by selecting the distance between each paddle to be less than the length of a stroke of the driving arms. This contributes to more thorough admixture of the waste material in the hopper.

The pump 10 of this invention incorporates a cylindrical hollow piston 17 journalled within a cylindrical tube 76 of the pumping chamber. This enables the use of antifriction bearings and seals, for example the bearings 90 and seal 91, between the hollow piston and the tube. The prior art hollow piston pumps having square or rectangular hollow pistons are not able to utilize bearings in this fashion. Further, the combination of a cylindrical piston within a cylindrical tube enables a close fit between the piston and the tube, to thereby minimize the problem of sprayback of waste materials back into the hopper during the pumping stroke of the piston, and sometimes even back into the barn; this sprayback is another adverse feature of hollow piston pumps using square or rectangular pistons. The problem of sprayback is further reduced by utilizing a seal, such as the seal 91, between the cylindrical hollow piston 17 and the cylindrical tube 76.

As mentioned previously, the pumping chamber 14 incorporated in the pump 10 is a unitary or cartridge element that can be removed completely from the lower housing 13 by disconnecting the attachment of the mounting plate 75 of the pumping chamber to the rear wall 67 of the lower housing 13. When the pumping chamber 14 is withdrawn from the lower housing (note the full line elements in FIG. 3) the cylindrical tube 76, elbow 77 and the attached back flow gate 79 are completely withdrawn as parts of the unit. This facilitates repair or replacement of the back flow gate 79 in particular, as well as other elements of the pumping chamber. As described previously, a manure pump such as the pump 10 is normally embedded in concrete underneath a barn. With the pump 10, the pumping chamber 14 is simply removed as a unit and withdrawn from the lower housing 13, thereby allowing a person to easily replace or repair the back flow gate 79 when necessary. The lifting lugs 88 are included with the pumping chamber 14 to allow it to be lifted by a chain hoist or other suitable apparatus for this purpose.

(C) Alternate Embodiments

Figure 8:
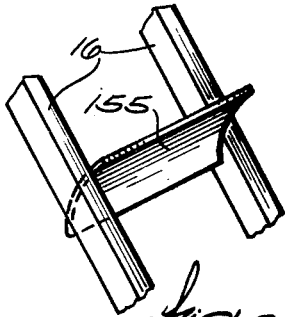
FIG. 8 is a partial perspective view of a second embodiment of paddles suitable for the manure pump.
Figure 9:
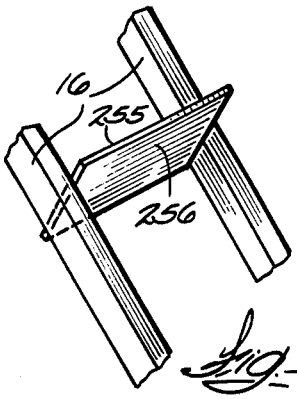
FIG. 9 is a partial perspective view of a third embodiment of paddles suitable for the manure pump.
Figure 5:
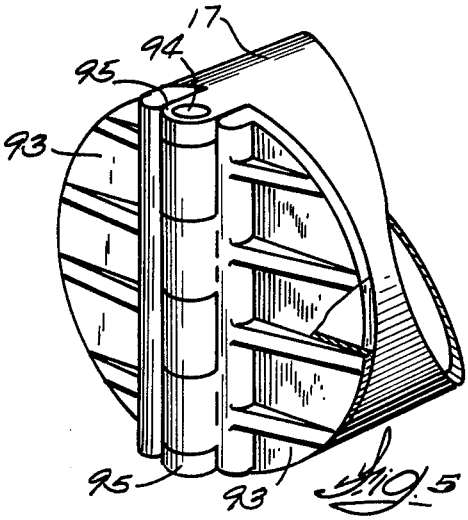
FIG. 5 is a perspective view illustrating the front end of the hollow piston incorporated in the pump.
Figure 7:
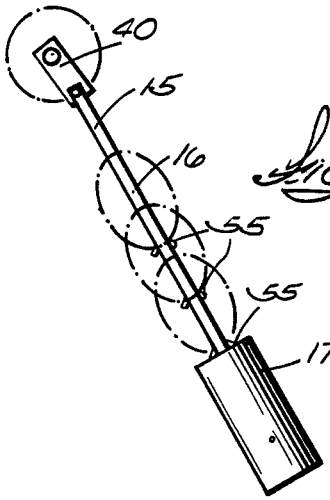
FIG. 7 is a diagrammatic view illustrating the action of the paddles incorporated in the pump.

FIGS. 8 and 9 illustrate two alternate constructions for the paddles. FIG. 8 depicts a curved paddle 155 carried between lower driving arms 16 and having its concave surface arranged to face the open end 92 of the hollow piston. FIG. 9 shows a flat paddle 255 positioned in a similar manner and having its largest surface 256 facing the open end 92 of the hollow piston.

Whatever construction is utilized for the paddles, they should have a substantial vertical dimension (relative to the driving arms) in order to develop effective agitating and transport actions. The paddles should extend about 1 inch or more above the upper surface of the driving arms and the same distance below the lower surface of the arms to operate most effectively; this dimension is indicated by the letter "X" in FIG. 1 and is measured perpendicular to the direction of movement of the driving arms. Flat horizontal plates between driving arms with a narrow edge surface facing the hollow piston as in prior art pumps do not provide the operational features of the paddles as disclosed herein.

(D) Example

A pump 10 was constructed as illustrated in FIGS. 1–7 with a hopper 11 with a capacity of 253 gallons and a lower housing 13 about 14 inches square and 37 inches long. The pumping chamber 14 included a cylindrical tube 76 that was 38 inches long with an inside diameter of 12"; the cylindrical hollow piston 17 had an outside diameter of 0.015" under 12 inches and was 14 inches long. The power transmission included a ten horsepower electric motor connected to a speed reducer so as to reciprocate the driving arms at 25 strokes per minute. The length of the stroke of the driving arms was adjustable in several increments between 12 inches and 18 inches. At a 12 inch stroke length, the pump was capable of developing a theoretical thrust of 4202 lbs. and had a theoretical volumetric capacity of 19.6 cubic feet per minute. With the 18 inch stroke length, the theoretical thrust was 2801 lbs. and theoretical volumetric capacity was 29.4 cubic feet per minute. The pump proved to be an efficient apparatus for pumping both liquid and solid waste materials. The paddles 55 incorporated with the pump were demonstrated to provide for effective agitation of the waste material in the hopper and to aid in moving the material into the open end of the hollow piston for subsequent pumping out of the hopper.

INDUSTRIAL APPLICABILITY

The pump 10 illustrated and described hereinabove is suitable for any agricultural use requiring the transport of solid and liquid animal wastes from a collection hopper to a storage area. Typical uses for the pump 10 are installations in a barn housing a herd of dairy cows or enclosures for any other farm animals. FIG. 10 illustrates an installation of this type in which the pump 10 is placed under the floor 25 of the barn 110. One end of discharge piping 111 is connected to the lower housing 13 of the pump along the conduit 66. The other end of the discharge piping opens onto a collection pit 112, that may be below ground level 113, in which waste material is collected until ready for future use such as spreading on the fields as fertilizer.

Various novel features of the pump 10 may be utilized with elements other than the specific combination illustrated herein. Thus, for example, the paddles 55, 155, or 255 can be employed between the driving arms of a hollow piston pump having a square or rectangular piston and will be fully capable of performing advantageous functions in such a unit. Further, the cylindrical hollow piston and the related pumping chamber can be employed without the paddles if so desired. It is expected that those skilled in the art of designing agricultural waste pumps will devise other modifications to the exemplary pump mechanism described above and it is intended that such modifications as would be obvious from the foregoing description are to be encompassed within the appended claims.

I claim:

1. In an animal waste pumping system of the type including (1) a hopper for the collection of waste material, (2) a lower housing attached to the hopper, (3) a pumping chamber within the lower housing, (4) a hollow piston reciprocable within the pumping chamber, and (5) drive means for reciprocating the hollow piston (a) through a pumping stroke during which waste material is pumped out of the hopper into discharge piping connected to receive waste material from the pumping chamber and (b) through a return stroke during which waste material from the hopper enters into and flows through the hollow piston for subsequent pumping, the hollow piston having a first end with pivotable gate means extending thereacross that close during the pumping stroke and open during the return stroke and an open second end, and the drive means including a pair of spaced driving arms connected to the hollow piston through the open second end thereof, the improvement comprising: a plurality of paddles connected across the spaced driving arms of the drive means and adapted to agitate waste material in the hopper and aid in transfer of waste material into the hollow piston.

2. Apparatus according to claim 2, wherein: each paddle is a V-shaped element opening towards the open second end of the hollow piston.

3. Apparatus according to claim 1, wherein: each paddle is a curved element having a concave surface opening towards the open second end of the hollow piston.

4. Apparatus according to claim 1, wherein: each paddle is a flat element having its largest surface facing the open second end of the hollow piston.

5. Apparatus according to claim 1, 2, 3 or 4 wherein: the paddles are spaced from one another a distance such that adjacent paddles have overlapping paths of travel during the pumping and return strokes.

6. In an animal waste pumping system of the type including (1) a hopper for the collection of waste material (2) a lower housing attached to the hopper, (3) a pumping chamber within the lower housing, (4) a hollow piston reciprocable within the pumping chamber, and (5) drive means for reciprocating the hollow piston (a) through a pumping stroke during which waste material is pumped out of the hopper into discharge piping connected to receive waste material from the pumping chamber and (b) through a return stroke during which waste material from the hopper enters into and flows through the hollow piston for subsequent pumping, the hollow piston having a first end with pivotable gate means extending thereacross that close during the pumping stroke and open during the return stroke and an open second end, and the drive means including a pair of spaced driving arms connected to the hollow piston through the open second end thereof, the improvement wherein:

the pumping chamber includes (1) a rear mounting plate adapted for attachment to the lower housing, (2) a cylindrical tube attached to and extending from the rear mounting plate, (3) a spacer plate secured to the cylindrical tube remote from the rear mounting plate and adapted to contact the interior of the lower housing to space the tube therefrom, and (4) backflow gate means pivotally mounted on the spacer plate and adapted to open during the pumping stroke of the hollow piston and close during the return stroke thereof, and the pumping chamber is removable from the lower housing as a unitary assembly including the rear mounting plate, cylindrical tube, spacer plate and backflow gate means.

7. Apparatus according to claim 6, wherein: the lower housing includes a rear wall, the rear mounting plate of the pumping chamber is attached to the rear wall of the lower housing, and the rear wall of the lower housing includes locating pins projecting therefrom that extend through openings in the rear mounting plate to position the pumping chamber relative to the lower housing.

8. In an animal waste pumping system of the type including (1) a hopper for the collection of waste material, (2) a lower housing attached to the hopper, (3) a pumping chamber within the lower housing, (4) a hollow piston reciprocable within the pumping chamber, and (5) drive means for reciprocating the hollow piston (a) through a pumping stroke during which waste material is pumped out of the hopper into discharge piping connected to receive waste material from the pumping chamber and (b) through a return stroke during which waste material from the hopper enters into and flows through the hollow piston for subsequent pumping, the hollow piston having a first end with pivotable gate means extending thereacross that close during the pumping stroke and open during the return stroke and an open second end, and the drive means including a pair of spaced driving arms connected to the hollow piston through the open second end thereof, the improvement wherein:

(A) a plurality of paddles are connected across the driving arms of the drive means and adapted to agitate waste material in the hopper and aid in transfer of waste material into the hollow piston;

(B) the pumping chamber includes, (1) a rear mounting plate adapted for attachment to the lower housing, (2) a cylindrical tube attached to and extending from the rear mounting plate, (3) a spacer plate secured to the cylindrical tube remote from the rear mounting plate and adapted to contact the interior of the lower housing to space the tube therefrom, and (4) backflow gate means pivotally mounted on the spacer plate and adapted to open during the pumping stroke of the hollow piston and close during the return stroke thereof; and (C) the hollow piston is a cylindrical element reciprocable within the cylindrical tube of the pumping chamber and includes, (1) antifriction bearing rings attached to its outer surface and along which the hollow piston is journalled inside the cylindrical tube, and (2) annular sealing means along its outer surface and arranged to reduce sprayback of waste material between said outer surface and the cylindrical tube of the pumping chamber.

* * * * *

UNITED STATES PATENT AND TRADEMARK OFFICE

CERTIFICATE OF CORRECTION

PATENT NO. : 4,445,823

DATED : May 1, 1984

INVENTOR(S) : Ronald L. Zyduck

It is certified that error appears in the above—identified patent and that said Letters Patent is hereby corrected as shown below:

Col. 3, line 60, the reference numeral "2" should be --12--.

Col. 9, line 16, (first line of claim 2), "2" should be --1--.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*